United States Patent [19]

Nakazawa et al.

[11] 4,413,046

[45] Nov. 1, 1983

[54] DISAZO PHOTOCONDUCTOR WITH NITROPHTHALIC ANHYDRIDE SENSITIZER

[75] Inventors: Toru Nakazawa, Kumatori; Akira Fushida, Suita, both of Japan

[73] Assignee: Mita Industrial Co., Ltd., Osaka, Japan

[21] Appl. No.: 365,050

[22] Filed: Apr. 2, 1982

[30] Foreign Application Priority Data

Apr. 6, 1981 [JP] Japan ..... 56/52208

[51] Int. Cl.[3] ..... G03G 5/06; G03G 5/09

[52] U.S. Cl. ..... 430/83

[58] Field of Search ..... 430/81, 83

[56] References Cited

U.S. PATENT DOCUMENTS 3,287,119 11/1966 Hoegl ..... 430/83 X
3,898,084 8/1975 Champ et al. ..... 430/71 X
4,302,521 11/1981 Takei et al. ..... 430/59

FOREIGN PATENT DOCUMENTS 9742 4/1980 European Pat. Off. ..... 430/83
44-14875 7/1969 Japan ..... 430/83

OTHER PUBLICATIONS

Contois et al., "Additives for Contrast Control in Organic Photoconductor Compositions and Elements", Res. Discl. 12240, Jun. 1974, pp. 33–34.

*Primary Examiner*—Roland E. Martin, Jr.
*Attorney, Agent, or Firm*—Sherman & Shalloway

[57] ABSTRACT

Disclosed is a photosensitive composition for electrophotography, which comprises a dispersion of a disazo-type photoconductor in an electrically insulating resin medium, wherein a nitrophthalic anhydride represented by the following formula:

wherein n is a number of 1 or 2, is incorporated as a sensitizer.

5 Claims, 1 Drawing Figure

DISAZO PHOTOCONDUCTOR WITH NITROPHTHALIC ANHYDRIDE SENSITIZER

BACKGROUND OF THE INVENTION (1) Field of the Invention

The present invention relates to a photosensitive composition for electrophotography. More specifically, the present invention relates to a photosensitive composition comprising a disazo-type photoconductor sensitized with a nitrophthalic anhydride and a binder resin.

(2) Description of the Prior Art

A photosensitive compositon formed by dispersing a disazo-type photoconductor in an electrically insulating resin medium has been widely used in the field of electrophotography, and it is known that polycyclic or heterocyclic nitrocompounds such as trinitroanthracene and 2,4,7-trinitrofluorenone, acid anhydrides such as phthalic anhydride and trimellitic anhydride and electron acceptors such as chloranil and bromanil are effective as the chemical sensitizer for this photosensitive composition.

SUMMARY OF THE INVENTION

We found that when a nitrophthalic anhydride, especially 4-nitrophthalic anhydride, is selected among various electron acceptors and is used as the sensitizer for a photosensitive composition comprising a dispersion of a disazo-type photoconductor in a binder resin, an excellent sensitizing effect not attainable by analogous compounds can be obtained.

It is therefore a primary object of the present invention to provide a photosensitive composition for electrophotography which comprises a novel sensitizer.

Another object of the present invention is to provide a photosensitive composition comprising a dispersion of a disazo-type photoconductor in a binder resin, which is excellent over known sensitive compositions in the sensitivity.

Still another object of the present invention is to provide a photosensitive composition comprising a sensitizer which is easily soluble in various organic solvents and is easily dispersible in an electrically insulating or photoconductive resin medium.

In accordance with the present invention, there is provided a photosensitive composition for electrophotography, which comprises a dispersion of a disazo-type photoconductor in an electrically insulating resin medium, wherein a nitrophthalic anhydride represented by the following formula:

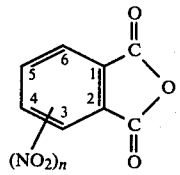

(I)

wherein n is a number of 1 or 2, is incorporated as a sensitizer.

BRIEF DESCRIPTION OF THE DESCRIPTION

FIG. 1 is a graph showing the charge decay characteristic of the photosensitive layer.

DETAILED DESCRIPTION OF THE PREFERRED EMBODIMENTS

Figure 1:
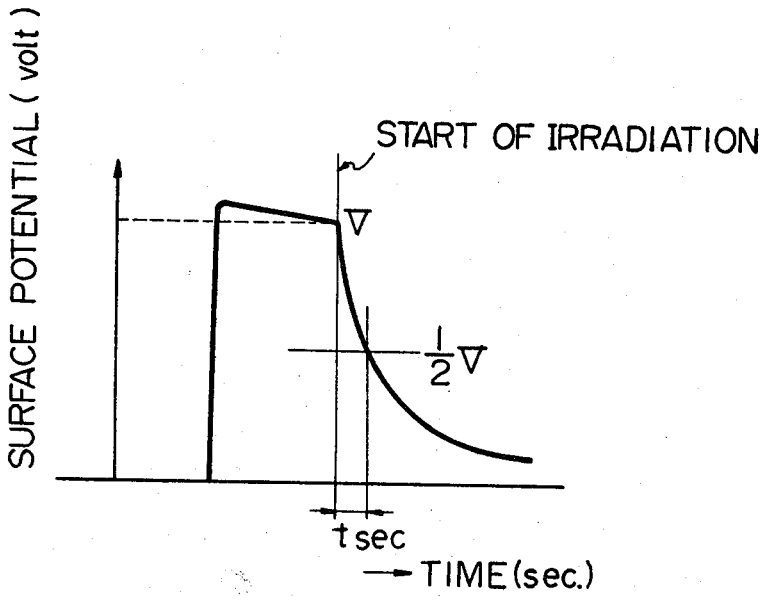

As pointed out hereinbefore, according to the present invention, by using a nitrophthalic anhydride of the above formula (I), the sensitivity of the disazo-type photoconductor layer is highly improved over the sensitivity attainable by using known sensitizers having an analogous chemical structure. As described in detail hereinafter, the sensitivity of the electrophotographic photosensitive layer is expressed by the exposure quantity (lux·sec) for half decay of the surface potential of the photosensitive layer, and the smaller is this value, the higher is the sensitivity. Phthalic anhydride which is a known sensitizer most analogous to the nitrophthalic anhydride used in the present invention has no substantial sensitizing effect to a Dian Blue/polyester resin system (see Comparative Example 4 given hereinafter). In contrast, if the nitrophthalic anhydride is used for this system, the sensitivity is increased and is about 6 times the original sensitivity. Furthermore, the sensitizing effect of the nitrophthalic anhydride is about 2.5 times the sensitizing effect of 2,4,7-trinitro-9-fluorenone (see Comparative Examples 2 and 7 given hereinafter), which is especially excellent in the sensitizing effect among polycyclic and heterocyclic nitro compounds. It is important that the sensitizing agent of the present invention should be used in the form of an acid anhydride. For example, 4-nitrophthalic acid has no substantial sensitizing effect (see Comparative Example 5 given hereinafter).

As the nitrophthalic anhydride represented by the formula (I), there can be mentioned 3-nitrophthalic anhydride, 4-nitrophthalic anhydride, 3,5-dinitrophthalic anhydride and 3,6-dinitrophthalic anhydride, and among them, 4-nitrophthalic anhydride is most preferred. These nitrophthalic anhydrides may be used singly or in the form of a mixture of two or more of them. Furthermore, the nitrophthalic anhydride may be used in combination with a sensitizer consisting of a known electron acceptor.

As the disazo-type photoconductor, there may be used all of known disazo pigments and their derivatives having a photoconductivity in the present invention. Preferred examples are described below though disazo-type photoconductors that can be used in the present invention are not limited to those exemplified below.

Benzidine Yellow G, Benzidine Yellow GR, Vulcan Fast Yellow G, Vulcan Fast Yellow 5G, Permanent Yellow NCG, C.I. Pigment Yellow 17, Permanent Yellow HR, Vulcan Fast Yellow R, Chromophthal Yellow 2G, Permanent H10G, Pyrazolone Orange (C.I. 21110), C.I. Pigment Orange 14 (C.I. 21165), C.I. Pigment Orange 15 (C.I. 21130), C.I. Pigment Orange 16, C.I. Pigment Orange 17 (C.I. 15510), C.I. Pigment Orange 31, C.I. Pigment Red 37 (C.I. 21205), C.I. Pigment Red 38 (C.I. 21120), C.I. Pigment Red 41 (C.I. 21200), C.I. Pigment Red 49 (C.I. 15630), C.I. Pigment Red 51 (C.I. 15580), C.I. Pigment Red 53 (C.I. 15585), Dian Blue (C.I. 21180), Chlorodian Blue, and their derivatives, dimers, trimers, oligomers, polymers and copolymers.

As the disazo-type photoconductor especially suitable for attaining the objects of the present invention, there can be mentioned Dian Blue (C.I. 21180) and its nucleus substituted derivatives such as nucleus halogen substituted derivatives, e.g., Chlorodian Blue.

In the present invention, as the electrically insulating resin medium, there can be used all of known electrically insulating thermoplastic resin and thermosetting resin binders. As preferred binders, there can be mentioned thermoplastic binders such as saturated polyester resins, polyamide resins, acrylic resins, ethylene-vinyl acetate copolymers, ion-crosslinked olefin copolymers (ionomers), styrene-butadiene block copolymers, polycarbonates, vinyl chloride-vinyl acetate copolymers, cellulose esters and polyimides, and thermosetting binders such as epoxy resins, urethane resins, silicone resins, phenolic resins, melamine resins, xylene resins, thermosetting acrylic resins, unsaturated polyester resins, bismaleimide resins and alkyd resins, though the binders that can be used in the present invention are not limited to those exemplified above. It is preferred that the volume resistivity of the electrically insulating resin be at least $1\times10^{14}$ Ω-cm as determined singly.

In the present invention, it is preferred that the nitrophthalic anhydride be used in an amount of 1 to 200 parts by weight, especially 10 to 150 parts by weight, per 100 parts by weight of the disazo-type photoconductor. If the amount of the nitrophthalic anhydride is too large and beyond the above range, the initial surface potential of the photosensitive layer tends to decrease, and if the amount of the nitrophthalic anhydride is too small and below the above range, the sensitizing effect is not satisfactory. From the viewpoints of the electrophotographic characteristics and various mechanical properties of the photosensitive layer, it is preferred that the weight ratio as solids of the disazo-type photoconductor to the electrically insulating resin be in the range of from 1/20 to 1/1, especially from 1/10 to ½.

In addition to the foregoing indispensable three components, known additives or compounding agents may be added to the photosensitive composition of the present invention according to known recipes. For example, thickeners, viscosity reducing agents, sag preventing agents, levelling agents, defoaming agents and sensitizing dyes may be added.

The photosensitive composition of the present invention is dissolved or dispersed in an organic solvent to form a coating composition, and the coating composition is coated on a conductive substrate and is then dried to form a photosensitive plate for electrophotography.

As the organic solvent that is used for formation of the coating composition, there can be mentioned aromatic hydrocarbons such as benzene, toluene and xylene, cyclic ethers such as dioxane and tetrahydrofuran, ketones such as methylethyl ketone, methylsiobutyl ketone and cyclohexanone, alcohols such as diacetone alcohols, ethylene glycol and isobutyl ether, and alicyclic hydrocarbons such as cyclohexane. These organic solvents may be used singly or in the form of a mixture of two or more of them. Since the nitrophthalic anhydride that is used in the present invention is easily soluble in these organic solvents, a homogeneous coating composition can be prepared. The preparation of the coating composition is easily carried out by dispersing the disazo-type photoconductor in the resin solution and also by dissolving the nitrophthalic anhydride therein. From the viewpoint of the adaptability to the coating operation, it is preferred that the concentration as solids of the coating composition be 1 to 50%, especially 5 to 30%.

As the conductive substrate, there may be used a foil, plate, sheet or drum of copper, aluminium, silver, tin or iron, and a thin film formed on a plastic film by vacuum evaporation deposition or non-electrolytic plating of a metal as mentioned above can also be used.

The photosensitive composition of the present invention may be applied to the substrate in the form of a layer having a thickness of 2 to 20μ, especially 3 to 10μ, as solids.

As described hereinbefore, the photosensitive composition of the present invention has an excellent sensitivity and shows a memory resistance when it is subjected to repeated light exposure. Accordingly, the photosensitive composition of the present invention can advantageously be used for various photosensitive plates for electrophotography, especially photosensitive plates for high-speed copying and photosensitive plates for laser printers.

The present invention will now be described in detail with reference to the following Examples that by no means limit the scope of the invention.

EXAMPLE 1

Dian Blue (C.I. 21180), 4-nitrophthalic anhydride and a polyester resin (Vylon RV-200 supplied by Toyobo Co.) were mixed at a weight ratio of 3/1/18 in tetrahydrofuran and kneaded for 24 hours in a ball mill. The resulting coating composition was coated on an aluminum plate having a thickness of 80 μm by a wire bar and dried at 100° C. for 1 hour to obtain a photosensitive layer having a thickness of 10 μm.

EXAMPLE 2

A photosensitive layer was formed in the same manner as described in Example 1 except that 3-nitrophthalic anhydride was used instead of 4-nitrophthalic anhydride used in Example 1.

EXAMPLE 3

A photosensitive layer was formed in the same manner as described in Example 1 except that 3,5-dinitrophthalic anhydride was used instead of 4-nitrophthalic anhydride used in Example 1.

EXAMPLE 4

A photosensitive layer was formed in the same manner as described in Example 1 except that 3,6-dinitrophthalic anhydride was used instead of 4-nitrophthalic anhydride used in Example 1.

EXAMPLE 5

A photosensitive layer was formed in the same manner as described in Example 1 except that Chlorodian Blue was used instead of Dian Blue (C.I. 21180) used in Example 1.

COMPARATIVE EXAMPLE 1

A photosensitive layer was formed in the same manner as described in Example 1 except that 4-nitrophthalic anhydride was not used.

COMPARATIVE EXAMPLE 2

A photosensitive layer was formed in the same manner as described in Example 1 except that 2,4,7-trinitro-9-fluorenone was used instead of 4-nitrophthalic anhydride used in Example 1.

COMPARATIVE EXAMPLE 3

A photosensitive layer was formed in the same manner as described in Example 1 except that chloranil was used instead of 4-nitrophthalic anhydride used in Example 1.

COMPARATIVE EXAMPLE 4

A photosensitive layer was formed in the same manner as described in Example 1 except that phthalic anhydride was used instead of 4-nitrophthalic anhydride used in Example 1.

COMPARATIVE EXAMPLE 5

A photosensitive layer was formed in the same manner as described in Example 1 except that 4-nitrophthalic acid was used instead of 4-nitrophthalic anhydride used in Example 1.

COMPARATIVE EXAMPLE 6

A photosensitive layer was formed in the same manner as described in Example 5 except that 4-nitrophthalic anhydride used in Example 5 was not used.

COMPARATIVE EXAMPLE 7

A photosensitive layer was formed in the same manner as described in Example 5 except that 2,4,7-trinitro-9-fluorenone was used instead of 4-nitrophthalic anhydride used in Example 5.

COMPARATIVE EXAMPLE 8

A photosensitive layer was formed in the same manner as described in Example 1 except that tetrachlorophthalic anhydride was used instead of 4-nitrophthalic anhydride used in Example 1.

The charge decay characteristics of the so-obtained photosensitive materials were determined by using an electrostatic paper analyzer (supplied by Kawaguchi Denki K.K.) as shown in FIG. 1 under the following conditions.

Measurement mode: static measurement II applied voltage: +6 Kvolt

Exposure: 40-lux tungsten light source

The surface potential V (volts) and the sensitivity (half decay exposure quantity) (t×40 lux·sec) were measured to obtain results shown in Table 1.

TABLE 1

| | Surface potential (volt) | Sensitivity (lux · sec) |
|---|---|---|
| Example 1 | 796 | 9.0 |
| Example 2 | 830 | 15.6 |
| Example 3 | 820 | 13.2 |
| Example 4 | 850 | 17.0 |
| Example 5 | 700 | 8.2 |
| Comparative Example 1 | 850 | 60.3 |
| Comparative Example 2 | 800 | 24.0 |
| Comparative Example 3 | 830 | 33.0 |
| Comparative Example 4 | 991 | 57.5 |
| Comparative Example 5 | 970 | 51.1 |
| Comparative Example 6 | 752 | 58.0 |
| Comparative Example 7 | 722 | 21.5 |
| Comparative Example 8 | 820 | 52.2 |

What we claim is:

1. A photosensitive composition for electrophotography, which consists essentially of (A) Dian Blue (C.I. 21180) or a nucleus halogen substituted derivative thereof as a photoconductor (B) 4-nitrophthalic anhydride as a sensitizer, and (C) an electrically insulating, electrophotographically inactive resin binder having a volume resistivity of at least $1\times10^{14}$ Ω-cm, the sensitizer (B) being present in an amount of 1 to 200 parts by weight per 100 parts by weight of the photoconductor (A) and the binder (C) being present at a weight ratio of from 1/20 to 1/1.

2. A photosensitive composition as set forth in claim 1, wherein the disazo-type photoconductor is Chlorodian Blue.

3. A photosensitive composition as set forth in claim 1, wherein the disazo-type photoconductor is Dian Blue.

4. The photosensitive composition according to claim 1 wherein the sensitizer (B) is present in an amount of from 10 to 150 parts by weight, per 100 parts by weight of the photoconductor (A).

5. The photosensitive composition of claim 4 wherein the photoconductor (A) and the binder (C) are present at a weight ratio of from 1/10 to ½.

* * * * *